US005199763A

United States Patent [19]

Wilder et al.

[11] Patent Number: 5,199,763

[45] Date of Patent: Apr. 6, 1993

[54] STANDING AID FOR USE WITH A CHECKOUT COUNTER

[75] Inventors: William D. Wilder; Roger D. Brown, both of Sylacauga, Ala.

[73] Assignee: Madix, Inc., Goodwater, Ala.

[21] Appl. No.: 695,587

[22] Filed: May 3, 1991

[51] Int. Cl.[5] ..... A47C 1/02

[52] U.S. Cl. ..... 297/338; 297/19; 297/330

[58] Field of Search ..... 297/338, 314, 330, 345, 297/383, 423, 355, 452, 14, 15; 248/163.1, 161, 124

[56] References Cited

U.S. PATENT DOCUMENTS

| | | | |
|---|---|---|---|
| 1,203,572 | 11/1916 | Betts | 297/338 X |
| 1,366,274 | 1/1921 | Orth | 297/345 |
| 3,095,232 | 6/1963 | Stevons | 297/14 X |
| 3,181,828 | 5/1965 | Cramer | 297/338 X |
| 3,405,972 | 10/1968 | Morris | 297/14 X |
| 4,653,808 | 3/1987 | Opsvik | 297/14 X |
| 4,768,831 | 9/1988 | Liedberg et al. | 297/345 |
| 4,869,501 | 9/1989 | Anastasakio | 248/161 X |

FOREIGN PATENT DOCUMENTS

| | | | |
|---|---|---|---|
| 2214170 | 10/1973 | Fed. Rep. of Germany | 297/345 |
| 353412 | 7/1931 | United Kingdom | 297/338 |
| 867164 | 5/1961 | United Kingdom | 297/338 |
| 2087228 | 5/1982 | United Kingdom | 297/345 |

*Primary Examiner*—Jose V. Chen
*Attorney, Agent, or Firm*—Hopkins & Thomas

[57] ABSTRACT

A standing aid for use with a checkout counter to assist an operator of the checkout counter while standing above a floor, comprising a base frame adapted to be mounted above the floor adjacent the checkout counter, a buttocks cushion adapted for engaging the buttocks of the operator of the checkout counter while standing, and support structure mounted to the base frame for movably supporting the buttocks cushion above the floor in a plurality of vertical positions and in a plurality of lateral positions, the buttocks cushion being pivotally mounted to the support structure.

31 Claims, 5 Drawing Sheets

STANDING AID FOR USE WITH A CHECKOUT COUNTER

TECHNICAL FIELD

The present invention relates to checkout counters and more particularly to a standing aid for use with checkout counters in the retailing and supermarket industries.

BACKGROUND OF INVENTION

Checkout counters, such as those used in the retailing and supermarket industries, typically require that the operator of the checkout counter stand for long periods of time, regardless of whether the current activity level is low or high. As is commonly known, standing for long periods of time places undue stress on the feet, legs and lower back, causing muscle and joint fatigue and discomfort.

U.S. Pat. No. 4,953,664 of Vrooman, et al addresses the problem of fatigue in operators of such checkout counters by providing a comprehensive checkout counter system for supermarket and merchandising industries. The checkout counter system includes a chair which allows the operator to sit and rest during periods of low activity. The chair can be swung out of the way to allow the operator to work while standing during periods of higher activity and is adjustable both vertically and horizontally. Unfortunately, many existing checkout counters cannot readily be provided with such a chair. Also, those individuals responsible for supervising checkout counter operators may be reluctant, for diverse reasons, to provide such a chair for the operators.

Accordingly, it can be seen that a need yet remains for an aid for use with a checkout counter to provide some relief from fatigue caused by working while standing for long periods of time. It is to the provision of such an aid that the present invention is primarily directed.

SUMMARY OF THE INVENTION

Briefly described, in a preferred form the present invention comprises a standing aid for use with a checkout counter to assist an operator of the checkout counter while standing above the floor. The standing aid includes a base frame adapted to be securely mounted above the floor adjacent the checkout counter and a buttocks cushion adapted for engaging the buttocks of the operator of the checkout counter while standing. Support means are mounted to the base frame for selectively movably supporting the buttocks cushion above the floor in both a plurality of vertical positions and a plurality of lateral positions relative to the base frame. Furthermore, the buttocks cushion is pivotally mounted to the support means.

Preferably, the support means comprises a first stanchion pivotally mounted to the base frame, and including a first or lower portion and a second or upper portion extendably mounted to the lower portion. The buttocks cushion is mounted to the upper portion of the first stanchion. The support means also includes a second stanchion pivotally mounted at first end thereof to the base frame, including a first or lower portion and a second or upper portion extendably mounted to the first portion. The second stanchion is pivotally mounted at a second end thereof, opposite the first end, to the first stanchion.

Preferably, the standing aid also includes a foot rest selectively movably mounted to the base frame for movement among a variety of selected positions.

With this construction, the standing aid is adaptable for use by operators of a broad range of heights by extending or retracting the upper portion of the first stanchion. Also, the angle of the first stanchion can be adjusted by extending the upper portion of the second stanchion to aid the operator while standing generally upright (such as during times of high activity) and to aid the operator while leaning backwardly (such as during periods of low or no activity). Furthermore, such a standing aid is adaptable for use with existing, already-installed checkout counters.

Accordingly, it is a primary object of the present invention to provide a standing aid for use with a checkout counter which is durable in construction, economical to manufacture, and effective in use.

It is another object of the present invention to provide a standing aid for use with a checkout counter which is useful for providing relief to an operator from fatigue from standing for long periods of time.

It is another object of the present invention to provide a standing aid which can be provided as a retrofit for existing checkout counters.

It is another object of the present invention to provide a standing aid for use with a checkout counter which is adaptable for use by operators of various heights.

It is yet a further object of the present invention to provide a standing aid for use with a checkout counter which is useful for aiding the operator of the checkout counter while standing generally upright and for aiding the operator of the checkout counter while leaning backwardly.

Other objects, features, and advantages of the present invention will become apparent upon reading the following specification in conjunction with the accompanying drawing figures.

BRIEF DESCRIPTION OF THE DRAWING FIGURES

DETAILED DESCRIPTION

Figure 1:
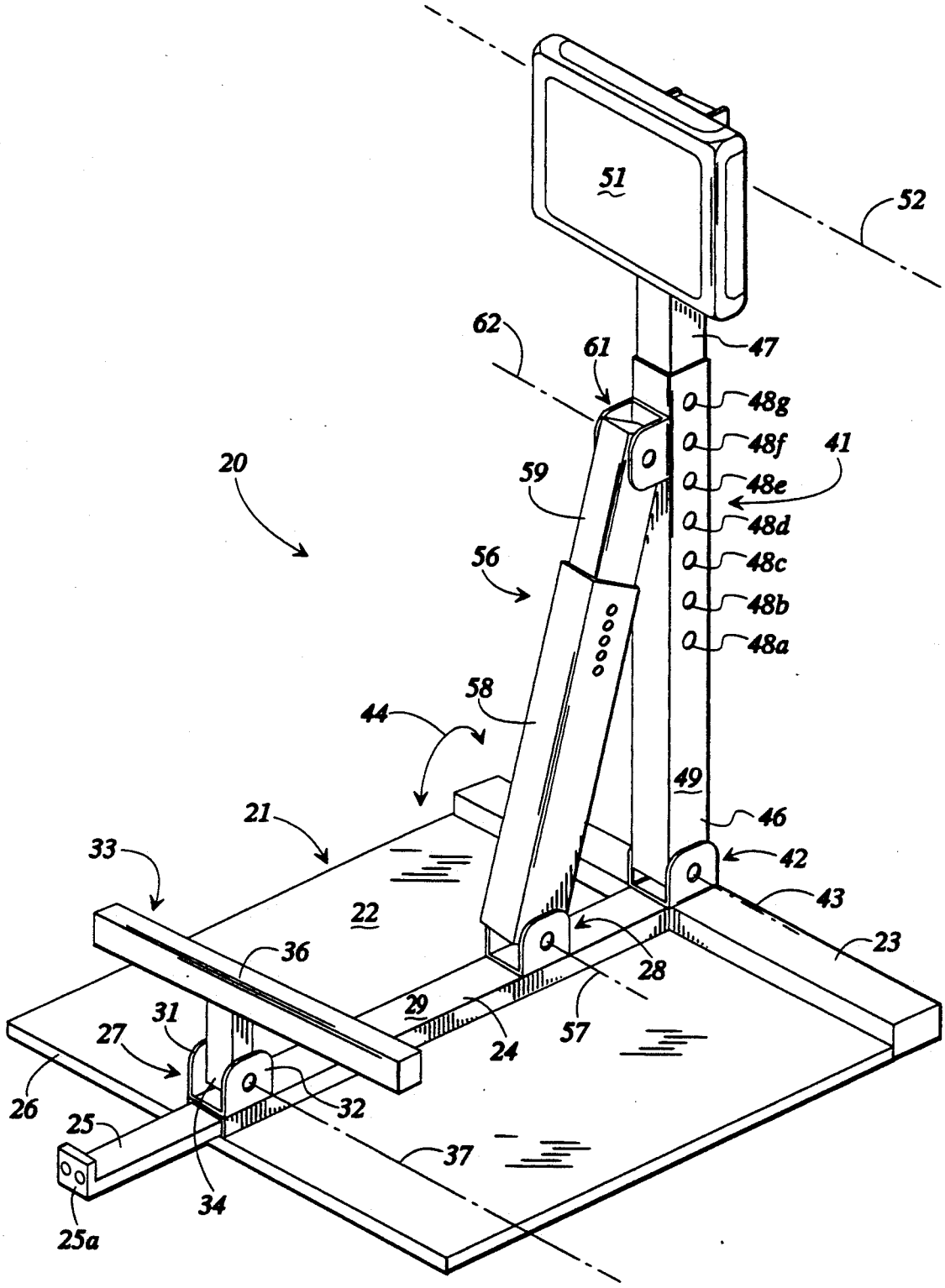
FIG. 1 is a perspective, schematic illustration of a standing aid according to a preferred form of the invention.

Referring now in detail to the drawing figures, wherein like reference characters denote like parts throughout the several views, FIG. 1 shows a standing aid 20 according to a preferred form of the invention and adapted for use with a checkout counter. The standing aid 20 includes a base frame 21 comprising a rectangular base panel 22 for positioning atop the ground or flooring. A first elongate reinforcement beam 23 is secured to one side of base panel 22 along one side edge thereof. The elongate reinforcing beam 23 is abutted by another elongate reinforcing beam 24 extending perpendicularly thereto from a central portion of elongate reinforcing beam 23 to a distal side edge 26 of base panel 22. In this way, the elongate reinforcing beams 23 and 24 form a T-shaped structure. Each of the elongate reinforcing beams 23 and 24 is formed of rectangular metal tubing. Foam fatigue mats can be placed on the base panel 22 on each side of the beam 24.

Figure 2:
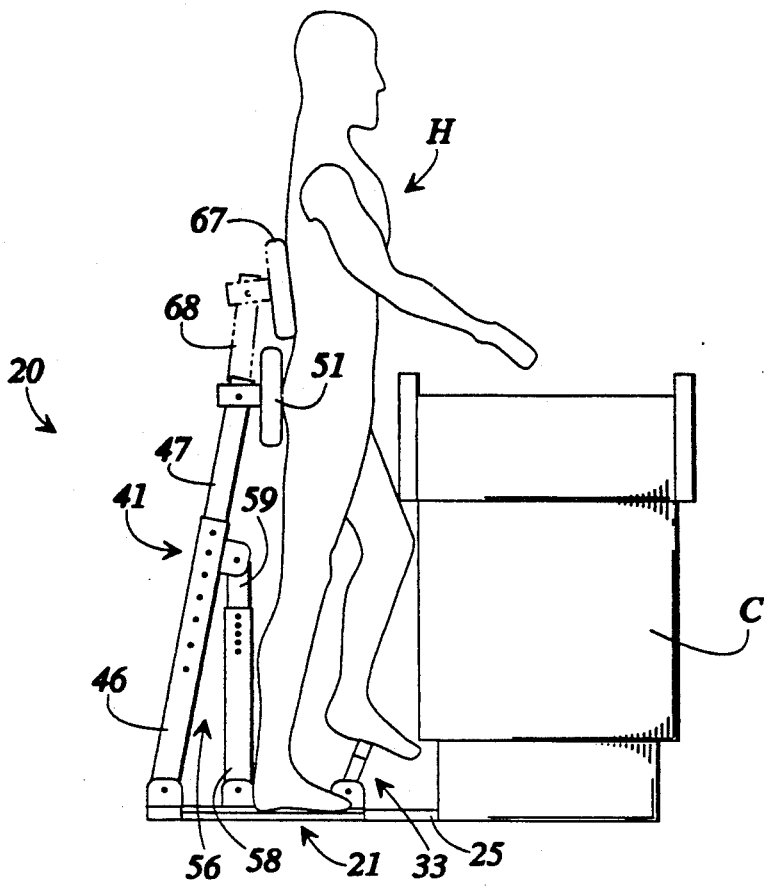
FIG. 2 is a schematic, side view of the standing aid of FIG. 1, shown positioned adjacent a checkout counter and shown being used by an operator of the checkout counter while standing generally upright.

Elongate beam 24 is hollow and telescopically receives therein an elongate mounting bracket 25 for mounting the standing aid 20 to a checkout counter, such as checkout counter C shown in FIG. 2, and includes a bolt flange 25*a* for this purpose. Elongate beam 24 and elongate mounting bracket 25 include means for selectively securing the elongate mounting bracket in place relative to elongate beam 24, and such means will be discussed in more detail below in connection with FIG. 5.

First and second brackets 27 and 28 are securely mounted to an upper surface 29 of elongate reinforcing beam 24. Bracket 27 is positioned at one end of the reinforcing beam adjacent side edge 26 of base panel 22, while the other bracket 28 is positioned generally distal therefrom, at a position approximately between one-half and three-fourths of the length of the reinforcing beam 24 from the side edge 26 of base panel 22. Each of the brackets 27 and 28 is made up of a pair of upstanding ears or tabs, such as ears 31 and 32 of bracket 27.

A footrest 33 is secured to the base frame 21 with the use of the bracket 27. The footrest 33 includes a short upright portion 34 and an elongated foot engaging portion 36 securely mounted to the short upright portion 34. The footrest is mounted to the bracket 27 for pivotal movement about an axis 37 extending through the bracket 27. As will be discussed in more detail below, means (unshown in FIG. 1) are provided for selectively securing the footrest in any of its various possible angular positions with respect to base frame 21.

A large upright stanchion 41 is pivotally mounted to a bracket 42, which in turn is mounted to elongate beam 23, for pivotal movement about axis 43 in the direction of double-headed direction arrow 44. Large upright stanchion 41 includes a first or lower portion 46 and a second or upper portion 47. The lower portion 46 is made up of an elongate rectangular tubing and having a series of apertures 48*a* through 48*g* formed in one side 49 thereof.

Upper or second portion 47 of stanchion 41 is telescopically (extendably) received within lower portion 46. A buttocks-engaging cushion 51 is pivotally mounted to the upper portion 47 of the stanchion 41 for pivotal movement about an axis 52 through a variety of pivotal positions. By virtue of the telescopic or extendable mounting of the upper portion to the lower portion 46, the height of buttocks cushion 51 above the ground or floor can be adjusted to adapt the standing aid for use by persons of widely different heights.

A bracing stanchion 56, somewhat smaller than the large upright stanchion 41, is pivotally mounted at one end thereof to bracket 28 for pivotal movement about an axis 57. Smaller bracing stanchion 56 comprises a first or lower portion and a second or upper portion 59. Each of the lower and upper portions 58 and 59 are elongate, rectangular tubing members, with upper portion 59 being telescopically received within lower portion 58. At an upper end of upper portion 59, the bracing stanchion 56 is pivotally mounted to a bracket 61, which is in turn mounted securely to an upper region of lower portion 46 of the large upright stanchion 41. The pivotal connection of the upper portion 59 of the bracing stanchion to the bracket 61 of the large upright stanchion 41 allows pivotal movement of the large upright stanchion 41 relative to the bracing stanchion 56 about an axis 62.

Figure 3:
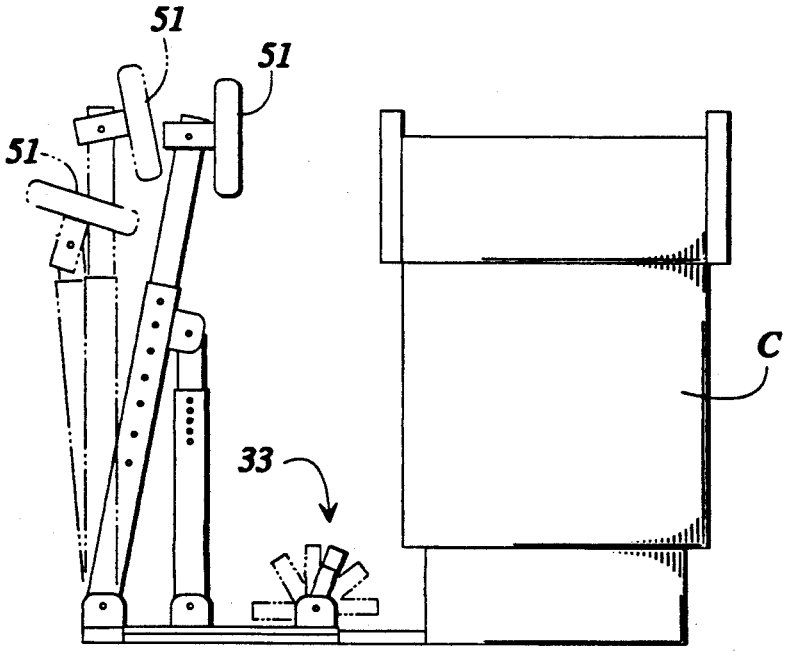
FIG. 3 is a schematic, side elevation view of the standing aid of FIG. 1, shown positioned adjacent a checkout counter and schematically showing ranges of motion of a buttocks cushion portion thereof and of a footrest portion thereof.

FIG. 2 shows the standing aid 20 positioned adjacent a checkout counter C and mounted thereto by an mounting bracket 25. FIG. 2 also shows a human operator H of the checkout counter standing generally upright, using the footrest 33 to prop one foot up thereon, and using the standing aid 20 to prop himself up somewhat. FIG. 2 also shows that a lumbar or lower back support cushion 67 can be mounted to an extension portion 68 of upper portion 47 of the large upright extension 41. FIG. 2 also shows that the buttocks cushion 51 is securely mounted to a mounting bracket 54, which in turn is pivotally mounted to the upper portion 47 of the large upright stanchion 41. FIG. 3 shows a typical range of motion for the footrest 33 and for the buttocks cushion 51, with some of the possible positions being shown in dashed lines.

Figure 4A:
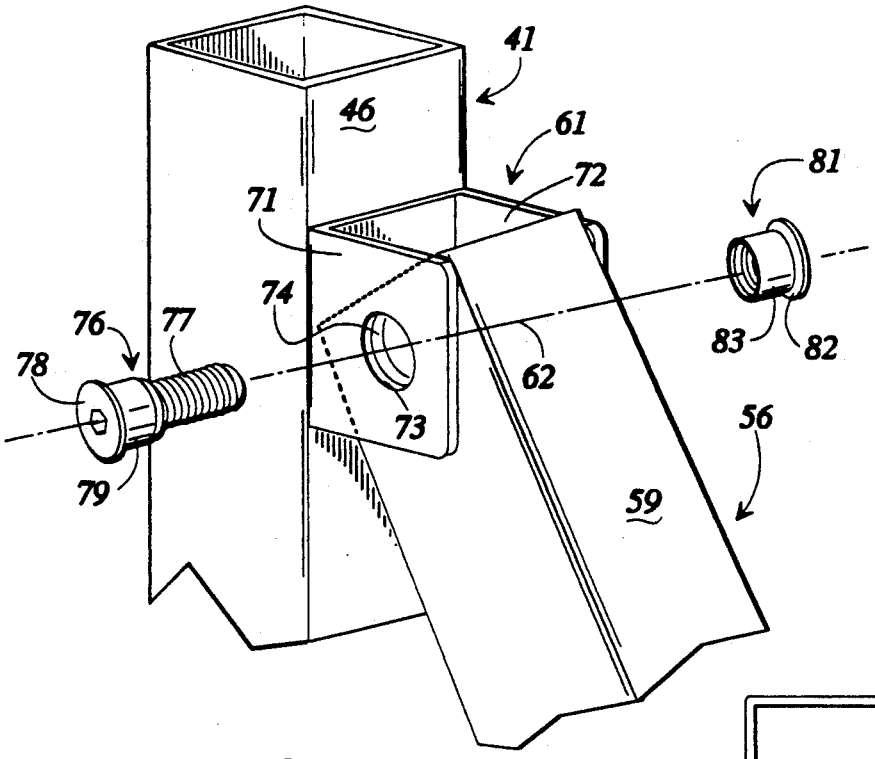
FIGS. 4A and 4B are a perspective, partially exploded view and a top, partially sectional view, respectively, of a pivoting joint construction portion of the standing aid of FIG. 1.
Figure 4B:
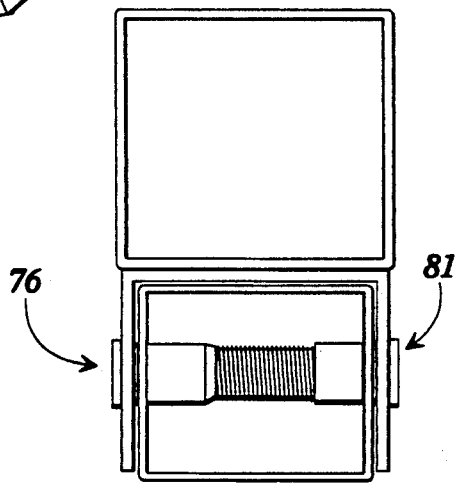

FIGS. 4A and 4B show a typical pivotal joint used at various locations of the standing aid 20. For example, the stanchions 41 and 56 are pivotally mounted to the base frame 21 with this technique, and are pivotally mounted to one another with this technique. For example, as shown in FIG. 4A, the upper portion 59 of bracing stanchion 56 is pivotally mounted to the lower portion 46 of stanchion 41 using a U-shaped bracket 61 which is welded or otherwise permanently secured to lower portion 46 of the upright stanchion 41. The U-shaped bracket 61 includes first and second parallel, spaced apart ears or tabs 71 and 72, with each of the ears having an aperture formed therein, such as aperture 73 formed in ear 71. A pair of aligned apertures are formed near the upper end of upper portion 59 of the bracing stanchion 56, such as aperture 74. A bolt 76 extends through the aligned apertures 73 and 74 along axis 62. The bolt includes a threaded shank 77, a head 78, and a smooth bearing shoulder 79. A nut 81 having a flange or head 82 and a smooth bearing shoulder 83 extends through two of the apertures and is threaded onto the threaded shank 77 to secure the bolt in place. The combination of smooth bearing shoulders on the nut and bolt and the apertures provides a smooth pivotal movement of the bracing stanchion relative to the large upright stanchion.

Figure 5:
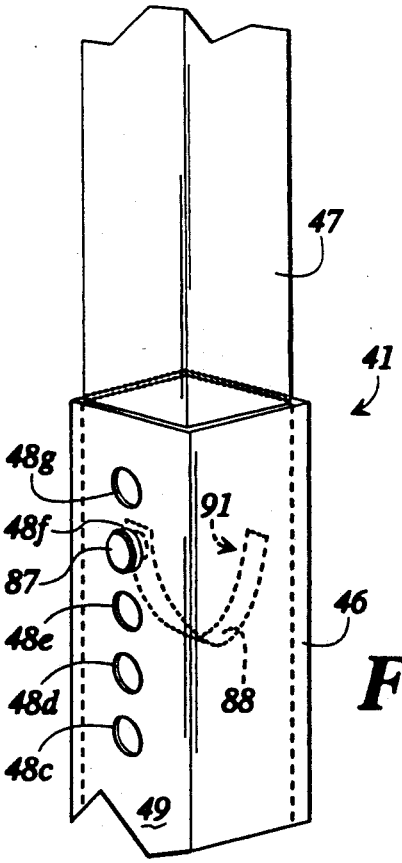
FIG. 5 is a perspective, schematic illustration of a portion of the standing aid of FIG. 1.

FIG. 5 shows an arrangement for selectively securing the extendable or telescopic upper stanchion portions in a selected position relative to the lower stanchion portions. For example, FIG. 5 depicts such a securing means as provided in the large upright stanchion 41. As discussed previously, the upper portion 47 of the stanchion is telescopically or slidably received within the lower portion 46. A series of apertures, such as the apertures 48c through 48g shown in FIG. 5, are provided in side panel 49 of the lower portion 46 of the stanchion. One aperture 86 is formed in the upper portion 47 of the stanchion. A cylindrical pin 87 is sized and adapted to be received within and extend through two aligned apertures. The pin 87 is spring urged outwardly through the aligned apertures by a biasing spring 88. The biasing spring is securely mounted at one end 91 thereof to an inside surface of upper portion 47 of the stanchion. The other end of the biasing spring 88 is rigidly secured to the cylindrical pin 87. However, the biasing spring, in the vicinity of the cylindrical pin, is larger, at least transversely, than the aligned apertures so that the biasing spring also acts as a limit or stop to prevent the pin from passing completely through the aligned apertures.

Figure 6A:
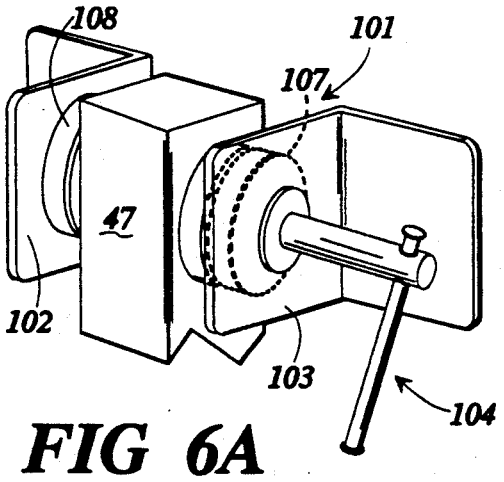
FIGS. 6A and 6B are a schematic, perspective view and a plan view, respectively, of a modified form of the standing aid of FIG. 1.
Figure 6B:
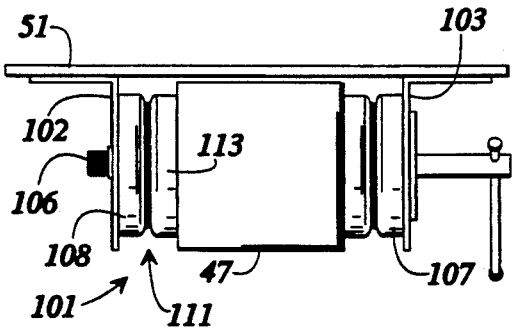

FIGS. 6A and 6B show another joint construction in which the joint connection includes a locking mechanism indicated generally at 101. This locking joint construction is used to mount the footrest 33 to the elongate beam 24 to mount the buttocks cushion 51 to the upper portion 47 of upright stanchion 41. In this arrangement, one element, for example the upper portion 47 of stanchion 41, can be secured in place and held against pivotal movement relative to the bracket ears by operation of a "vice handle" indicated at 104. The vice handle 104 turns a threaded nut onto a threaded shaft 106 to urge a first plate 107 toward a second plate 108, thereby compressing any elements positioned therebetween. By tightening the vice handle, first and second pairs 111 and 112 of opposed splined plates or toothed faces are forced together, thereby locking these plates to one another to prevent relative rotation. As the first of the splined plates in pair 111 is rigidly secured to plate 108 and also thereby rigidly secured to tab 102, and since the other of the toothed gear plates is secured to plate 113 which is rigidly mounted to upper portion 47 of the stanchion, locking the two gear plates together effectively locks the upper portion 47 of the stanchion to the bracket tabs 102 and 103. A similar locking takes place with splined plate pair 112 bracket tabs 102 and 103 include plates 102a and 103a, respectively, which are permanently secured, as by welding, to either the back of buttocks cushion 51, the back of back support cushion 67, or footrest 33.

Figure 7:
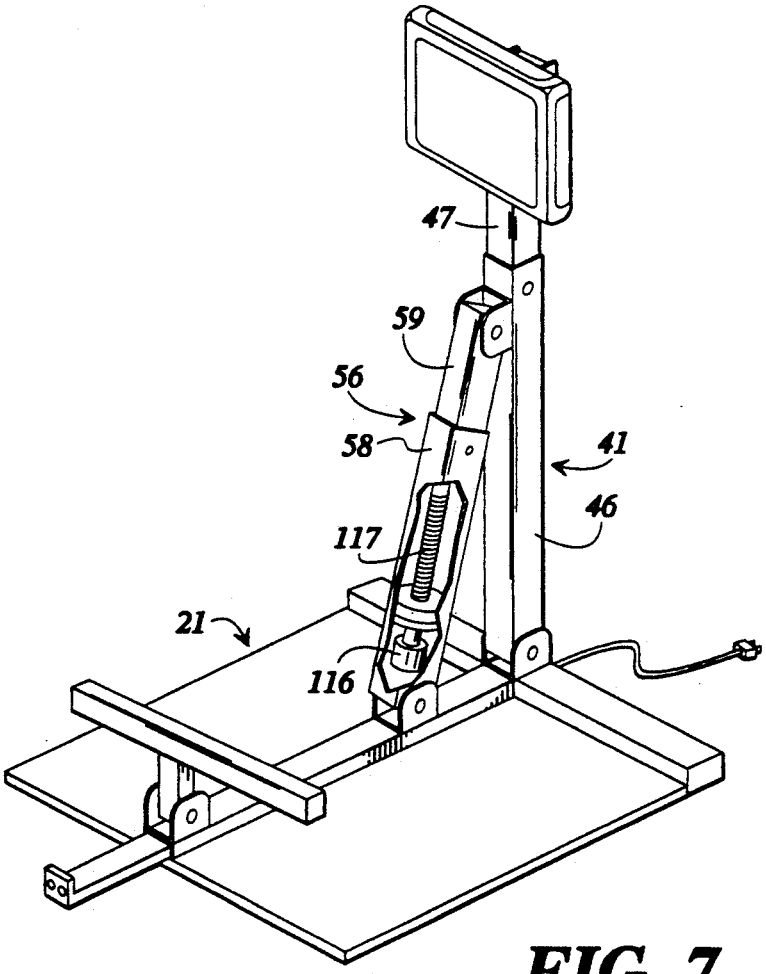
FIG. 7 is a perspective, partially cut away illustration of a standing aid in a second preferred form of the invention including electric actuating means.

FIG. 7 shows an alternative embodiment of the present invention in which the pin and aperture arrangement of FIG. 5 is replaced with an electric actuator means for adjusting the angle of stanchion 41 relative to the base frame 21 and for raising and lowering upper portion 47 of stanchion 41 relative to the lower portion 46 thereof. As shown in the cutaway portion of lower portion 58 of the bracing stanchion 56, an electric motor 116 is securely mounted in a lower region of lower portion 58 and drives a threaded shaft 117 selectively in clockwise and counter-clockwise directions. The shaft is received in a threaded member (unshown) rigidly secured within upper portion 59 of the bracing stanchion 56. With this construction, by operation of an unshown switch to cause the motor 116 to drive the threaded screw 117 in either clockwise or counter-clockwise rotation, the upper portion 59 of the bracing stanchion is caused to move downwardly or upwardly, respectively, as determined by the direction of rotation of the threaded shaft and the "hand" of the threads thereon. A similar arrangement (unshown) can be provided for raising and lowering the upper portion 47 of the large upright stanchion 41.

Figure 8:
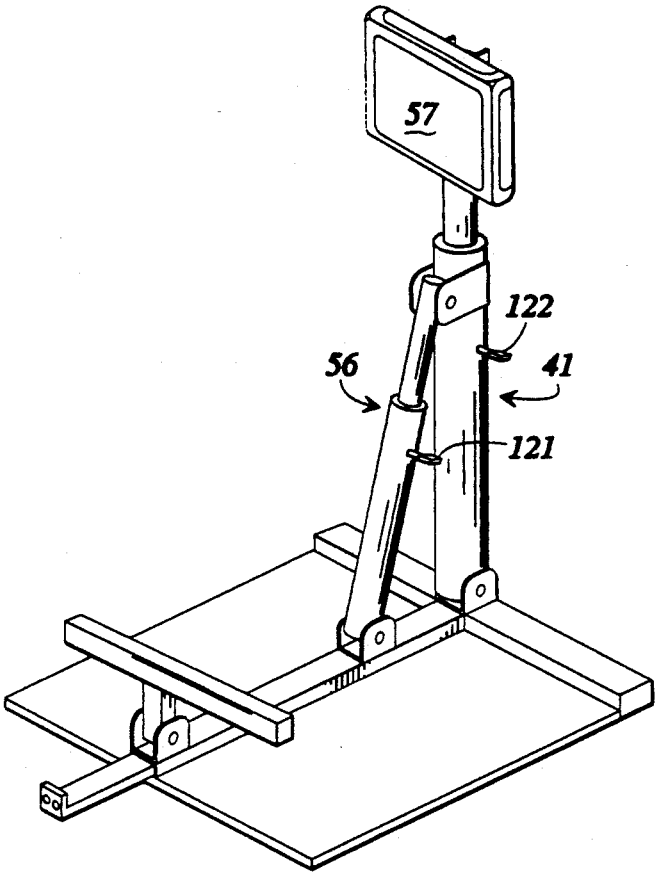
FIG. 8 is a perspective, schematic illustration of a standing aid in a third preferred form of the invention including double acting gas cylinders for raising and lowering and for laterally adjusting the buttocks cushion thereof.

FIG. 8 shows another alternative embodiment in which the bracing stanchion 56 and the upright stanchion 41 are provided as double acting gas cylinders, with each double acting gas cylinder including a hand-operated release valve 121 and 122 for allowing the operator to adjust the angle of upright stanchion 41 (and thereby the lateral position of the buttocks cushion 51) and the height of the buttocks cushion 51 by manipulation of the valves 121 and 122 in conjunction with the judicious application or removal of force, either laterally or vertically, to allow the buttocks cushion to move back and forth laterally or to move up and down.

Figure 9A:
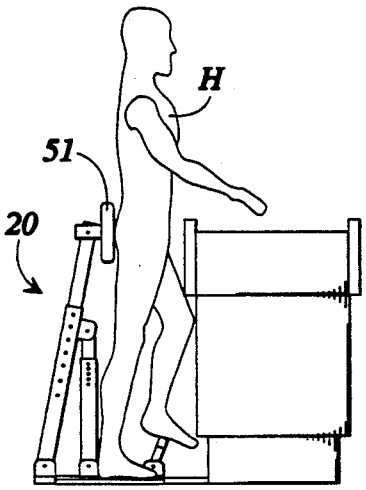
FIGS. 9A through 9C are schematic, side elevation views of the standing aid according to the present invention showing an operator of a checkout counter using the standing aid while standing substantially upright, while leaning backwardly slightly, and while partially seated, respectively.
Figure 9B:
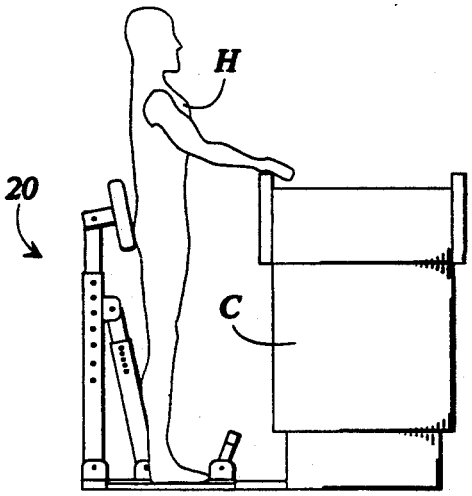
Figure 9C:
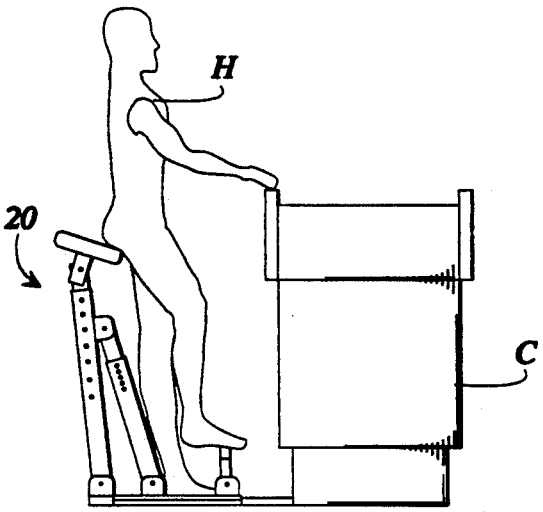

FIG. 9A shows that the standing aid 20 can be used to prop one foot, or both, on the footrest 33 while standing substantially upright with the buttocks cushion 51 providing some additional support for the operator H of the checkout counter C. FIG. 9B shows that the standing aid 20 is useful for supporting the operator H when leaning backwardly somewhat away from the checkout counter C. FIG. 9C furthermore shows that the standing aid 20 can even be used to provide some vertical support for the operator's body weight in a partially seated position.

With this construction, the standing aid is adaptable for use by operators of a broad range of heights by extending or retracting the upper portion of the first stanchion. Also, the angle of the first stanchion can be adjusted by extending the upper portion of the second stanchion to aid the operator while standing generally upright (such as during times of high activity) and to aid the operator while leaning backwardly (such as during periods of low or no activity). Furthermore, such a standing aid is adaptable for use with existing, already-installed checkout counters. The standing aid according to the above description is simple and durable and provides an operator with relief from fatigue from standing for long periods of time. Also, the standing aid can be used by operators of widely different heights and can be provided as a retrofit for existing checkout counters.

While the invention has been disclosed in preferred forms only, it will be obvious to those skilled in the art that many additions, deletions, and modifications can be made therein without departing from the spirit and scope of the invention as set forth in the following claims.

We claim:

1. A standing aid for use with a checkout counter to assist an operator thereof while standing above a floor, comprising:

a base frame mounted above the floor adjacent the checkout counter;

mounting means for securing said base frame in close proximity to said floor and for opposing tilting forces exerted against said base frame by said operator;

a first stanchion pivotally mounted to said base frame and including a lower portion and an upper portion extendably mounted to said lower portion, said first stanchion capable of forward pivotal adjustment;

a second stanchion pivotally mounted at a lower portion thereof to said base frame and including an upper portion extendably mounted to said lower portion, said second stanchion pivotally mounted at one end thereof to said first stanchion;

a buttocks cushion pivotally mounted to said upper portion of said first stanchion; and means for selectively securing said buttocks cushion in selected vertical and lateral positions.

2. A standing aid as claimed in claim 1 wherein said means for selectively securing said buttocks cushion comprises means for selectively securing said first stanchion in a selected pivotal position relative to said base frame and means for selectively securing said lower portion of said first stanchion relative to said upper portion of said first stanchion.

3. A standing aid as claimed in claim 1 further comprising a footrest movably mounted to said base frame.

4. A standing aid as claimed in claim 1 further comprising actuator means for moving said buttocks cushion through said plurality of vertical positions and through said plurality of lateral positions.

5. A standing aid as claimed in claim 4 wherein said actuator means comprises a double-acting gas cylinder.

6. A standing aid as claimed in claim 4 wherein said actuator means comprises electric motor means.

7. A standing aid for use with a checkout counter to assist an operator of the checkout counter while standing above a floor, comprising:

a base frame adapted to be mounted above the floor adjacent the checkout counter;

a buttocks cushion adapted for engaging the buttocks of the operator of the checkout counter while standing;

support means mounted to said base frame for movably supporting said buttocks cushion above the floor in a plurality of vertical positions and in a plurality of lateral positions, said buttocks cushion being pivotally mounted to said support means, said support means comprising a first stanchion pivotally mounted to said base frame at a lower end thereof and including a lower portion and an upper portion extendably mounted to said lower portion, and a second stanchion pivotally mounted at a lower portion thereof to said base frame and including an upper portion extendably mounted to said lower portion, said second stanchion pivotally mounted at the upper portion thereof to said first stanchion; and first means for securing said lower portion of said first stanchion to said upper portion of said first stanchion for selectively preventing said upper portion from moving relative to said lower portion, and second securing means for selectively preventing said upper portion of said second stanchion from moving relative to said lower portion of said second stanchion, said first means for securing comprising at least one aperture formed in one of said lower and upper portions, a plurality of apertures formed in the other of said lower and upper portions, and a pin which is spring-urged toward said apertures and which is sized and adapted to be received in said apertures.

8. The standing aid of claim 7, wherein said second securing means comprises at least one aperture formed in one of said lower and upper portions, a plurality of apertures formed in the other of said lower and upper portions, and a pin which is spring-urged toward said apertures and which is sized and adapted to be received in said apertures.

9. A standing aid for use with a checkout counter to assist an operator of the checkout counter while standing above a floor, comprising:

a base frame adapted to be mounted above the floor adjacent the checkout counter;

a buttocks cushion adapted for engaging the buttocks of the operator of the checkout counter while standing; and support means mounted to said base frame for movably supporting said buttocks cushion above the floor in a plurality of vertical positions and in a plurality of lateral positions, said buttocks cushion being pivotally mounted to said support means, said support means comprising a first stanchion pivotally mounted to said base frame at a lower end thereof and including a lower portion and an upper portion extendably mounted to said lower portion, said first stanchion capable of forward pivotal adjustment, and a second stanchion pivotally mounted at a lower portion thereof to said base frame and including an upper portion extendably mounted to said lower portion, said second stanchion pivotally mounted at said upper portion thereof to said first stanchion.

10. A standing aid as claimed in claim 9 further comprising means for selectively securing said buttocks cushion in place in both said plurality of vertical positions and said plurality of said lateral positions.

11. A standing aid as claimed in claim 9 further comprising an actuator means for tilting said buttocks cushion through said plurality of vertical positions and through said plurality of lateral positions.

12. A standing aid as claimed in claim 11 wherein said actuator means comprises a double acting gas cylinder.

13. A standing aid as claimed in claim 11 wherein said actuator means comprises electric motor means.

14. A standing aid as claimed in claim 9 further comprising a foot rest movably mounted to said base frame.

15. A standing aid as claimed in claim 9 further comprising:

a first securing means for securing said lower portion of said first stanchion to said upper portion of said first stanchion for selectively preventing said upper portion from moving relative to said lower portion; and a second securing means for selectively preventing said upper portion of said second stanchion from moving relative to said lower portion of said second stanchion.

16. A standing aid as claimed in claim 15 wherein said first securing means comprises at least one aperture formed in one of said lower and upper portions, a plurality of apertures formed in the other of said lower and upper portions, and a pin which is spring-urged toward said apertures and which is sized and adapted to be received in said apertures.

17. A standing aid as claimed in claim 16 wherein said second securing means comprises at least one aperture formed in one of said lower and upper portions, a plurality of apertures formed in the other of said lower and upper portions, and a pin which is spring-urged toward said apertures and which is sized and adapted to be received in said apertures.

18. A standing aid as claimed in claim 9 further comprising means for resisting pivotal movement of said buttocks cushion relative to said support means.

19. A standing aid as claimed in claim 9 further comprising a back rest cushion mounted to said support means, said back rest cushion being positioned above said buttocks cushion.

20. A standing aid as claimed in claim 9 further comprising means for adjustably mounting said base frame to the checkout counter.

21. A standing aid for use with a checkout counter to assist an operator of the checkout counter while standing above a floor, comprising:

a base frame adapted to be mounted above the floor adjacent the checkout counter;

a buttocks cushion adapted for engaging the buttocks of the operator of the checkout counter while standing;

support means mounted to said base frame for movably supporting said buttocks cushion above the floor in a plurality of vertical positions and in a plurality of lateral positions, said buttocks cushion being pivotally mounted to said support means, said support means comprising a first stanchion pivotally mounted to said base frame at a lower end thereof and including a lower portion and an upper portion extendably mounted to said lower portion, said first stanchion capable of forward pivotal adjustment, and a second stanchion pivotally mounted at a lower portion thereof to said base frame and including an upper portion extendably mounted to said lower portion, said second stanchion pivotally mounted at said upper portion thereof to said first stanchion;

a first securing means for securing said lower portion of said first stanchion to said upper portion of said first stanchion for selectively preventing said upper portion from moving relative to said lower portion; and second securing means for selectively preventing said upper portion of said second stanchion for moving relative to said lower portion of said second stanchion.

22. A standing aid as claimed in claim 21 further comprising means for selectively securing said buttocks cushion in place in both said plurality of vertical positions and said plurality of said lateral positions.

23. A standing aid as claimed in claim 21 further comprising an actuator means for tilting said buttocks cushion through said plurality of vertical positions and through said plurality of lateral positions.

24. A standing aid as claimed in claim 23 wherein said actuator means comprises a double acting gas cylinder.

25. A standing aid as claimed in claim 23 wherein said actuator means comprises electric motor means.

26. A standing aid as claimed in claim 21 further comprising a foot rest movably mounted to said base frame.

27. A standing aid as claimed in claim 21 further comprising means for resisting pivotal movement of said buttocks cushion relative to said support means.

28. A standing aid as claimed in claim 21 further comprising a back rest cushion mounted to said support means, said back rest cushion being positioned above said buttocks cushion.

29. A standing aid as claimed in claim 21 further comprising means for adjustably mounting said base frame to the checkout counter.

30. A standing aid as claimed in claim 21 wherein said first securing means comprises at least one aperture formed in one of said lower and upper portions, a plurality of apertures formed in the other of said lower and upper portions, and a pin which is spring-urged toward said apertures and which is sized and adapted to be received in said apertures.

31. A standing aid as claimed in claim 21 wherein said second securing means comprises at least one aperture formed in one of said lower and upper portions, a plurality of apertures formed in the other of said lower and upper portions, and a pin which is spring-urged toward said apertures and which is sized and adapted to be received in said apertures.

* * * * *